US009761998B2

(12) United States Patent
De Dios Martin et al.

(10) Patent No.: US 9,761,998 B2
(45) Date of Patent: Sep. 12, 2017

(54) RELEASE TAB FOR AN ELECTRICAL CONNECTOR AND ELECTRICAL CONNECTOR COMPRISING SAID RELEASE TAB

(75) Inventors: Longinos De Dios Martin, Barcelona (ES); Els Blazejczak, Landen (BE); Paul John Pepe, Clemmons, NC (US)

(73) Assignees: CommScope Technologies LLC, Hickory, NC (US); CommScope Connectivity Spain, S.L., Madrid (ES); CommScope Connectivity Belgium BVBA, Kessel-Lo (BE)

( * ) Notice: Subject to any disclaimer, the term of this patent is extended or adjusted under 35 U.S.C. 154(b) by 72 days.

(21) Appl. No.: 13/984,446

(22) PCT Filed: Feb. 7, 2012

(86) PCT No.: PCT/EP2012/052036

§ 371 (c)(1),
(2), (4) Date: Aug. 8, 2013

(87) PCT Pub. No.: WO2012/107439

PCT Pub. Date: Aug. 16, 2012

(65) Prior Publication Data

US 2013/0323949 A1 Dec. 5, 2013

(30) Foreign Application Priority Data

Feb. 8, 2011 (ES) ..... 201130168

(51) Int. Cl.
*H01R 13/62* (2006.01)
*H01R 13/633* (2006.01)
(Continued)

(52) U.S. Cl.
CPC ..... *H01R 13/6335* (2013.01); *H01R 13/6272* (2013.01); *H01R 24/64* (2013.01)

(58) Field of Classification Search
CPC .. G02B 6/3806; G02B 6/3869; G02B 6/3885; G02B 6/3887; G02B 6/3893;
(Continued)

(56) References Cited

U.S. PATENT DOCUMENTS 5,011,424 A 4/1991 Simmons
5,090,916 A 2/1992 Magnier
(Continued)

FOREIGN PATENT DOCUMENTS

CN 1658441 A 8/2005
CN 1770568 A 5/2006
(Continued)

OTHER PUBLICATIONS

International Search Report for International Application No. PCT/EP2012/052036 mailed Mar. 22, 2012. (2 pages).
(Continued)

*Primary Examiner* — Amy Cohen Johnson
*Assistant Examiner* — Milagros Jeancharles
(74) *Attorney, Agent, or Firm* — Merchant & Gould P.C.

(57) ABSTRACT

The present invention relates to a release tab (37) for an electrical connector (1), comprising a body (38) and an unlocking nose (42) for unlatching a latch (13) securing the electrical connector (1) connected with a mating connector (2), as well as to an electrical connector (1) comprising a housing (4), a latch (13) for securing the housing (4) to a mating connector (2), the latch (13) extending from the housing (4), having an opening (19), as well as being transferable to an unlatched position, and a release tab (37) being arranged movable between a released position and an actuated position, and having an unlocking nose (42) extending into the opening (19) to transfer the latch (13) to the unlatched position when moving the release tab (37) from the released position to the actuated position. For
(Continued)

providing an improved release tab and an improved electrical connector of a simple and compact design, allowing the connector to be unplugged in high density applications, the unlocking nose (42) is arranged at a cantilever (41) projecting from the body (38), and the release tab (37) of the present invention is arranged at the electrical connector.

27 Claims, 12 Drawing Sheets

(51) Int. Cl.
*H01R 13/627* (2006.01)
*H01R 24/64* (2011.01)

(58) Field of Classification Search
CPC .. G02B 6/3897; G02B 6/4249; H01R 13/633; H01R 13/6272; H01R 13/6275; H01R 23/025
USPC ..... 385/53, 58, 59, 62, 70, 71, 76, 78, 86, 385/89; 439/155, 160, 344, 352, 353, 439/354, 357, 358
See application file for complete search history.

(56) References Cited

U.S. PATENT DOCUMENTS 5,123,071 A 6/1992 Mulholland et al.
5,211,572 A 5/1993 Comsctock et al.
5,315,679 A 5/1994 Baldwin et al.
5,335,301 A 8/1994 Newman et al.
5,462,457 A 10/1995 Schroepfer
5,481,634 A 1/1996 Anderson et al.
5,574,812 A 11/1996 Beier et al.
5,579,425 A 11/1996 Lampert et al.
5,638,474 A 6/1997 Lampert et al.
5,651,690 A * 7/1997 Klas ..... H01R 31/005 439/352
5,675,682 A 10/1997 De Marchi
6,024,498 A 2/2000 Carlisle et al.
6,076,974 A 6/2000 Carlisle et al.
6,196,733 B1 3/2001 Wild
6,250,817 B1 6/2001 Lampert et al.
6,250,942 B1 6/2001 Lemke et al.
6,254,418 B1 7/2001 Tharp et al.
6,276,839 B1 8/2001 De Marchi
6,325,547 B1 12/2001 Cammons
6,357,934 B1 3/2002 Driscoll
6,435,732 B1 8/2002 Asao
6,443,627 B1 9/2002 Anderson
6,447,170 B1 9/2002 Takahashi et al.
6,692,289 B2 2/2004 Nemoto
6,776,645 B2 8/2004 Roth et al.
6,863,556 B2 3/2005 Viklund
6,885,560 B2 4/2005 Zaremba
6,994,580 B1 2/2006 Chen
7,037,129 B2 5/2006 Lo et al.
7,052,186 B1 5/2006 Bates
7,101,212 B1 9/2006 Larkin
7,163,414 B2 1/2007 Lo et al.
7,281,938 B1 10/2007 Wu
7,297,013 B2 11/2007 Caveney et al.
7,326,075 B1 2/2008 Armstrong et al.
7,329,137 B2 2/2008 Martin et al.
7,354,292 B1 4/2008 Lloyd et al.
7,413,473 B2 * 8/2008 Wu ..... 439/557
7,421,181 B2 9/2008 Kanou et al.
7,425,159 B2 * 9/2008 Lin ..... 439/676
7,440,670 B2 10/2008 Kanou et al.
7,445,484 B2 11/2008 Wu
7,465,180 B2 12/2008 Kusuda et al.
7,534,125 B1 5/2009 Schroll
7,534,128 B2 5/2009 Caveney et al.
7,549,888 B1 * 6/2009 Armstrong ..... H01R 13/633 439/354
7,588,373 B1 9/2009 Sato et al.
7,594,766 B1 9/2009 Sasser et al.
7,632,125 B2 12/2009 Irwin et al.
7,641,398 B2 1/2010 O'Riorden et al.
7,651,361 B2 1/2010 Henry et al.
7,666,023 B2 2/2010 Wu
7,690,939 B2 * 4/2010 Wu ..... H01R 9/032 439/160
7,736,171 B2 * 6/2010 Reed et al. ..... 439/352
7,753,710 B2 7/2010 George
7,771,225 B1 8/2010 Wu
7,892,012 B1 * 2/2011 Foung ..... H01R 13/6272 439/344
8,152,384 B2 4/2012 De Jong et al.
8,152,385 B2 4/2012 De Jong et al.
8,187,018 B2 * 5/2012 Kosugi ..... H01R 13/6272 439/344
8,221,007 B2 * 7/2012 Peterhans ..... G02B 6/3893 385/53
8,235,745 B1 8/2012 Armstrong et al.
8,267,712 B2 * 9/2012 Huang ..... H01R 43/26 439/344
8,317,532 B2 11/2012 Kosugi
8,382,506 B2 2/2013 Reed et al.
8,465,317 B2 6/2013 Gniadek et al.
8,556,645 B2 * 10/2013 Crain ..... H01R 13/6272 438/258
8,690,593 B2 4/2014 Anderson
8,747,141 B2 * 6/2014 Crain ..... H01R 13/6272 439/258
8,764,308 B2 7/2014 Irwin et al.
8,864,390 B2 10/2014 Chen
8,870,466 B2 10/2014 Lu
8,876,403 B2 11/2014 Katoh
8,979,569 B2 * 3/2015 Aekins ..... H01R 13/633 439/352
9,557,495 B2 1/2017 Raven et al.
9,570,852 B2 2/2017 Plamondon et al.
2002/0090177 A1 7/2002 Anderson
2003/0017729 A1 * 1/2003 Huang ..... H01R 13/6272 439/108
2003/0220008 A1 11/2003 Viklund et al.
2003/0220080 A1 11/2003 Chuberre et al.
2003/0220081 A1 11/2003 Dykstra et al.
2003/0220082 A1 11/2003 Yoshida
2003/0220083 A1 11/2003 Lee et al.
2003/0220084 A1 11/2003 Makarov
2003/0220085 A1 11/2003 Khawand
2003/0220086 A1 11/2003 Birkett
2003/0220087 A1 11/2003 Suhonen
2003/0220088 A1 11/2003 Cowley et al.
2003/0220089 A1 11/2003 Change et al.
2003/0222008 A1 12/2003 Nightlinger et al.
2004/0247252 A1 12/2004 Ehrenreigh
2005/0054230 A1 3/2005 Huang
2005/0058404 A1 3/2005 Ngo
2005/0124201 A1 6/2005 Lo et al.
2006/0049826 A1 3/2006 Daneman et al.
2006/0089039 A1 4/2006 Caveney
2007/0049082 A1 3/2007 Wu
2007/0077806 A1 4/2007 Martin et al.
2007/0140621 A1 6/2007 Decusatis
2007/0232118 A1 10/2007 Wu
2007/0298636 A1 12/2007 Kusuda et al.
2008/0030220 A1 2/2008 Agarwal et al.
2008/0226237 A1 9/2008 O'Riorden et al.
2009/0042424 A1 2/2009 Kaneda
2009/0047818 A1 2/2009 Irwin et al.
2009/0245732 A1 10/2009 Murano
2010/0216325 A1 8/2010 Huang
2010/0220961 A1 9/2010 De Jong et al.
2011/0058773 A1 3/2011 Peterhans et al.
2011/0081113 A1 4/2011 Jones
2011/0091159 A1 4/2011 de Jong et al.
2011/0183541 A1 7/2011 Kosugi
2011/0217008 A1 9/2011 Cline
2011/0299814 A1 12/2011 Nakagawa
2012/0057826 A1 3/2012 Katoh

(56) References Cited

U.S. PATENT DOCUMENTS

| | | | | |
|---|---|---|---|---|
| 2012/0155810 | A1 | 6/2012 | Nakagawa | |
| 2012/0208388 | A1 | 8/2012 | Kosugi | |
| 2012/0213478 | A1 | 8/2012 | Chen | |
| 2012/0308183 | A1 | 12/2012 | Irwin et al. | |
| 2013/0115794 | A1* | 5/2013 | Chang | H01R 13/6335 439/160 |
| 2013/0163934 | A1 | 6/2013 | Lee et al. | |
| 2013/0301994 | A1 | 11/2013 | Motofuji | |
| 2013/0323949 | A1 | 12/2013 | De Dios Martin et al. | |
| 2014/0141641 | A1 | 5/2014 | De Dios Martin et al. | |
| 2014/0169727 | A1 | 6/2014 | Veatch et al. | |
| 2016/0116685 | A1 | 4/2016 | Wong et al. | |
| 2016/0356962 | A1 | 12/2016 | Moriyama et al. | |
| 2017/0031109 | A1 | 2/2017 | Meadowcroft et al. | |

FOREIGN PATENT DOCUMENTS

| | | | |
|---|---|---|---|
| CN | 101065888 | A | 10/2007 |
| CN | 101160696 | A | 4/2008 |
| CN | 101133524 | A | 8/2008 |
| CN | 101313441 | A | 11/2008 |
| CN | 102365568 | A | 2/2012 |
| CN | 103091793 | A | 5/2013 |
| EP | 1 653 566 | | 5/2006 |
| EP | 1 855 360 | | 11/2007 |
| EP | 2063497 | | 5/2009 |
| EP | 2144100 | | 1/2010 |
| EP | 2 337 163 | | 6/2011 |
| JP | S63-184271 | | 7/1988 |
| JP | 2003526116 | | 9/2003 |
| WO | WO 2004/065999 | | 8/2004 |
| WO | WO 2006/047258 | | 5/2006 |
| WO | WO 2007/044310 | A1 | 4/2007 |
| WO | WO 2009/135787 | | 11/2009 |
| WO | WO 2010/038283 | | 8/2010 |
| WO | WO 2012/054174 | | 8/2012 |
| WO | WO 2012/107439 | | 8/2012 |
| WO | WO 2012/107441 | | 8/2012 |
| WO | WO 2012/151175 | | 11/2012 |
| WO | WO 2013/124785 | | 8/2013 |
| WO | WO 2015/103783 | | 7/2015 |

OTHER PUBLICATIONS

International Search Report for International Application No. PCT/EP2012/052039 mailed May 31, 2012. (3 pages).

Spanish Search Report for corresponding application No. ES 201130169 mailed May 24, 2013 (with English Translation), 10 pages.

Spanish Search Report for application No. ES 201130168 mailed Jul. 1, 2013 (with English Translation); 8 pages.

International Search Report for International Application No. PCT/IB2013/051329 mailed Jun. 13, 2013 (2 pages).

International Written Opinion for International Application No. PCT/IB2013/051329 mailed Jun. 13, 2013 (7 pages).

Chinese Office Action dated Jun. 18, 2015; CN Patent Appln. No. 201280017445.X; 5 pages.

Chinese Office Action dated May 22, 2015; CN Patent Appln. No. 201280017489.2; 7 pages.

Search Report and Chinese Office Action dated Jun. 18, 2015; CN Patent Appln. No. 201280017445.X; 5 pgs.

Search Report and Chinese Office Action dated May 22, 2015; CN Patent Appln. No. 201280017489.2; 7 pgs.

* cited by examiner

RELEASE TAB FOR AN ELECTRICAL CONNECTOR AND ELECTRICAL CONNECTOR COMPRISING SAID RELEASE TAB

This application is a National Stage Application of PCT/EP2012/052036, filed 7 Feb. 2012, which claims benefit of Serial No. P201130168, filed 8 Feb. 2011 in Spain and which applications are incorporated herein by reference. To the extent appropriate, a claim of priority is made to each of the above disclosed applications.

BACKGROUND

The present invention relates to a release tab for an electrical connector, comprising a body and an unlocking nose for unlatching a latch securing the electrical connector connected with a mating connector.

The present invention further relates to an electrical connector comprising a housing; a latch for securing the housing to a mating connector, the latch extending from the housing, having an opening, as well as being transferable to an unlatched position; and a release tab being arranged moveable between a released position and an actuated position, and having an unlocking nose extending into the opening to transfer the latch to the unlatched position when moving the release tab from the released position to the actuated position.

In the electronics industry, and in particular the telecommunications industry, there is a trend towards more densely packaged connectors and connector systems. For example, in switching networks, such as patch panels, the connectors are positioned tightly spaced in multiple rows.

Because the rows are positioned in such close proximity, difficulties arise when accessing the latching mechanism that is securing the connector to the mating connector of the panel. The spacing between the adjacent connectors, in particular in high density applications, is too small to accommodate the fingers to release the latching mechanism. A further problem arises in that the latching mechanism is typically positioned at the mating interface of the connector with the panel so that the cables and/or the adjacent connectors block access to the latching mechanism.

To overcome the above problems, special tools have been developed to reach into the tight spaces to release the latching mechanism such that the electrical connector may be removed. However, such tools are cumbersome to use.

U.S. Pat. No. 7,651,361 B2 discloses an electrical connector having a housing, a latch extending from the housing for securely coupling the housing to a mating connector, said latch being depressible to an unlatched position, and a tether mated with the latch. The tether is moveable between a released position and an actuated position and depresses the latch to the unlatched position, when being moved to the actuated position. The tether is mated with the latch by including an embossment, which extends into a window of the latch and engages an edge of the window to transfer the latch to the unlatched position.

The connector of U.S. Pat. No. 7,651,361 B2 requires a specific design of the connector housing. In particular, the latch profile is specifically arranged and designed for being actuable by the tether. Furthermore, the specifically designed hood portion is necessary for the connector of U.S. Pat. No. 7,651,361 B2. The hood is elevated from the housing and so that the connector U.S. Pat. No. 7,651,361 B2 requires extra space.

In view of the above, the objective technical problem of the present invention is to provide an improved release tab and an improved electrical connector of a simple and compact design, comprising such release tab allowing the connector to be unplugged in high density applications.

SUMMARY

The present invention solves this problem by arranging the unlocking nose at a cantilever projecting from the body of the release tab.

The initially mentioned electrical connector solves the above-defined technical problem by comprising a release tab according to the present invention.

This easy and simply solution allows for a flexible arrangement and alignment of the locking nose with respect to the body of the tab. Due to this flexibility, the release tab can be used for an arbitrary plug, in particular a standard plug, whose latch is provided with a window for receiving the unlocking nose. Due to the arrangement of the unlocking nose at the cantilever projecting from the body of the release tab, the cantilever and the unlocking nose form a hook-like structure that allows for secure accommodation of the unlocking nose in the window of the latch. The hook-like structure furthermore facilitates the accommodation of the unlocking nose in the window of the latch, and the body of the release tab can be arranged closer to the housing of the electrical connector since the body does not need to arrange the body of the electrical connector above the latch, like in the connector of U.S. Pat. No. 7,651,361 B2. Rather, only the cantilever elevates the unlocking nose above the latch for engaging the nose in the opening, while the reminder of the tab body can be close to the housing allowing a compact design.

The solution according to the present invention may be combined in any way with the following advantageous embodiments of the present invention respectfully and further improved.

According to an embodiment of the release tab, the cantilever projects from the body against the direction in which the unlocking device protrudes from the cantilever and/or in which the latch is transferred to the unlatched position upon moving the release tab from the released position to the actuated position.

According to a further embodiment of the release tab, a tip of the unlocking nose and a free end of the cantilever are arranged, in the projection of the actuations direction along which the release tab is moved from the released position to the actuated position, at opposite sides of the body. In particular, the free end of the cantilever is arranged before the body, with respect to the unlatching direction, along which the latch is transferred to the unlatched position when moving the release tab to the actuated position, while the tip of the unlocking nose I arranged after the body in the projection along the unlatching direction or depression direction in case of a depressible latch. The unlocking nose may be arranged at the retaining end at the free end of the cantilever.

These embodiments allow for a compact design of an electrical connector having the release tab assembled a close distance to the connector housing. Contrary to the release tab of U.S. Pat. No. 7,651,361 B2, according to which the entire body of the release tab is located further away from the housing than the latch, the release tab according to the present invention makes it possible to arrange the body of the release tab close to the connector housing. It minimises the distance at which the release tab body is arranged from the connector housing. The release tab according to the present invention can be arranged closer to the connector housing because only the cantilever projects to such an extent form the body allowing the free or distal end of the cantilever to be arranged before the latch, in the projection along the unlatching or depression direction. Nevertheless, the release tip of the present invention is capable of depressing the latch for unlatching since the cantilever projecting from the body may be designed such that the cantilever rises from the connector housing above the free end of the latch. Since the unlocking nose is arranged at the cantilever, in particular at the free end thereof, it is then still possible to extend the unlocking nose into the opening of the latch.

For avoiding that the unlocking nose is moved out of the opening when moving the release tab from the released position to the actuated position, the tip of the nose may comprise a stopper limiting the displacement of the latch, relative to the nose in the unlatching or depression direction. The stopper may be a catch protruding from the tip of the nose.

According to a further embodiment, the electrical connector of the present invention may further comprise a detachment device for transferring the latch to the unlatched position. The detachment device and/or the release tab may be adapted to allow transfer of the latch to the unlocked position by the detachment device even if the release tab is arranged at the connector. According to this embodiment, the latch does not necessarily has to be released by means of the release tab. Alternatively, the latch be released using the detachment device, which might be more convenient in certain situations depending on the mating connector with which the electrical connector is mated, e.g. in case the detachment device is freely accessible from the outside or when the electrical connector is densely packed with adjacent connectors. The release tab may be adapted for allowing to actuate the detachment device for transferring the latch to the unlatched position, at least in the released position of the release tab.

According to a further embodiment of the release tab, the cantilever has a window. The latch may extend through the window of the cantilever, such that, viewed from the side, the cantilever crosses the latch. This allows for a compact design, according to which it is not even necessary for the free end of the cantilever to be arranged, with respect to the connector housing, above the free tip of the latch. Further the window provides a guidance for the transfer of the latch to the unlatched position and at the same time a cover avoiding a deformation of the latch other than the intended transfer to the unlatching position. Moreover, the window makes room for moving the detachment device for transferring the latch the unlatched position, so that the detachment device may be actuated even if the release tab is arranged at the connector in the released position.

In a further embodiment of the electrical connector, the connector further comprises a hood covering at least the free tip of the latch. The free tip of the latch, in particular in connectors used for ethernet links, generally points in the direction in which the electrical connector is removed from the mating connector. Thus, there is the risk that the free tip of the latch gets caught in an adjacent connector or cable when removing a connector, which may damage the latch and the electrical connector. This is avoided by providing the electrical connector with a hood covering at least the free tip of the latch, which is thus protected by the hood.

According to a further embodiment, the hood may comprise the unlatching device and thereby fulfil the double function of providing the cover protecting the tip of the latch and at the same time providing in a simple and compact manner the unlatching device of the electrical connector. The hood may be hinged to a part of the electrical connector, e.g. the housing, a shielding element or a boot. In one embodiment, the hood may be integrally formed with the connector housing, the shielding or the boot of the connector.

According to a further embodiment, the release tab may comprise a handle. The handle facilitates the operation of the release tab. In a further embodiment, an actuation device can be attached to the body of the release tab. The actuating device may either be formed integrally with the body of the release tab or the handle thereof, or directly be attached thereto, e.g. by connecting the actuating tool with an adhesive joint, a positive-fit or non-positive fit. The actuating device can be either also be made as a separate part providing a tool for actuating the release tab from even a longer distance than if using a release tab without the actuation device. In one embodiment, the actuation device may be a tail made from a plastic or textile that is attached to the body of the release tab. This tail may simultaneously be used as label for the connector or as a means of color codification for distinguishing an electrical connector in a high density application.

In a further embodiment, the release tab may comprise a coupling element for attaching the actuation device to the body. The coupling element may be for example a hook or an opening in the body, which can be engaged with the actuation tool. The release tool, e.g. a bar or rod, may be provided at one end with a counter coupling element to be engaged with the coupling end of the release tab. The actuation device may be adjustable in length for adapting the length of the actuation device to the environment in which the electrical connector is used. Further, the end of the actuation tool that is opposite the end, which is attached to the release tab, can be fastened, e.g. at the cable of the connector.

According to a further embodiment, the release tab of the present invention may comprise a catch for securing the release tab against lifting off from the electrical connector, in particular, against lifting off against the unlatching direction provided by the resilience of the latch when transferred to the unlatched position.

The catch may be provided at the cantilever or at the body in a region that is aligned with or is adjacent to or close to the unlocking nose of the release tab. The catch achieves that the release tab is not pushed away from the connector housing when the latch is transferred to the unlatched position. Thus, the unlocking nose remains principally at the same distance with respect to the connector housing when transferring the release tab into the actuated position so that the reactive forces acting from the latch to the unlocking nose when the latch is released are compensated and lead into the catch and a hood portion, such as the hood of the connector according to U.S. Pat. No. 7,651,361 B, is not necessary to avoid the release tab being moved away from the electrical connector.

For directing the movements of the release tab, when assembled with the connector, according to a further embodiment, the release tab of the present invention may comprise at least one guide element. The electrical connector may comprise at least one counter-guide element for engaging with and forming a guiding with a guide element of the release tab. The guide element in conjunction with the counter-guide element realise that the release tab is moveable only in and against a pre-determined actuation direction with respect to the connector housing. In an embodiment, the body and/or the catch may comprise a guide element of the release tab according the present invention. Alternatively, the body of the tab may form or comprise a guide element of the release tab.

In a further embodiment, the release tab comprises at least two guide-elements. This realises in a simple and easy construction a uni-translation movement of the release tab with respect to the connector housing only in and against the pre-determined actuation direction, without the risk of tilting due to the two-point guidance.

In a further embodiment, the catch forms or comprises a guide element of the release tab.

The electrical connector according to the present invention may, in a further embodiment, comprise a counter-guide element, such as a slot, groove, rib or rail, forming a guidance with a guide bar or a guide rib or guide gip of the release tab.

In a further embodiment, the detachment device and/or the hood of the electrical connector may comprise the counter guide element so that the detachment device and/or the hood serve at least two functions, one of which is to guide the relative movement of the release tab with respect to the electrical connector housing and the other is the above-mentioned advantages of the attachment device and the hood.

According to a further embodiment, the electrical connector of the present invention may comprise a boot surrounding at least section-wise the housing. The boot may serve as a strain relief element and furthermore comprise at least one of the detachment device, the hood and/or a counter guide element according to one of the above-described embodiments.

BRIEF DESCRIPTION OF THE DRAWINGS

The invention is described hereafter by means of examples referring to exemplary embodiments with reference to the drawings. The various features of the described embodiments can be combined or omitted independently of one another as already described above.

In the Figures.

DETAILED DESCRIPTION

Figure 1:
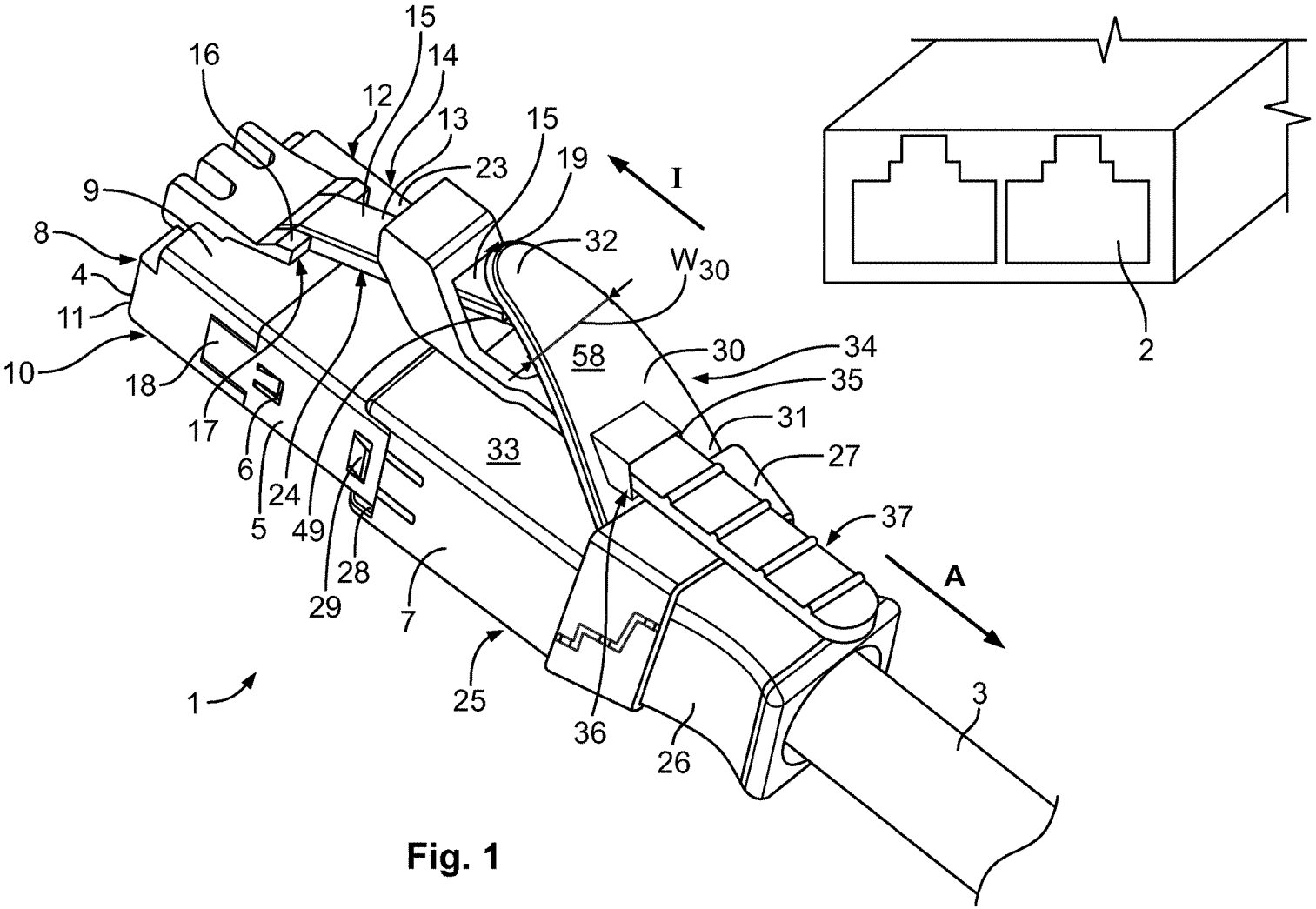
FIG. 1: shows a schematic representation of an electrical connector in a first embodiment comprising a first embodiment of a release tab according the present invention.
Figure 2:
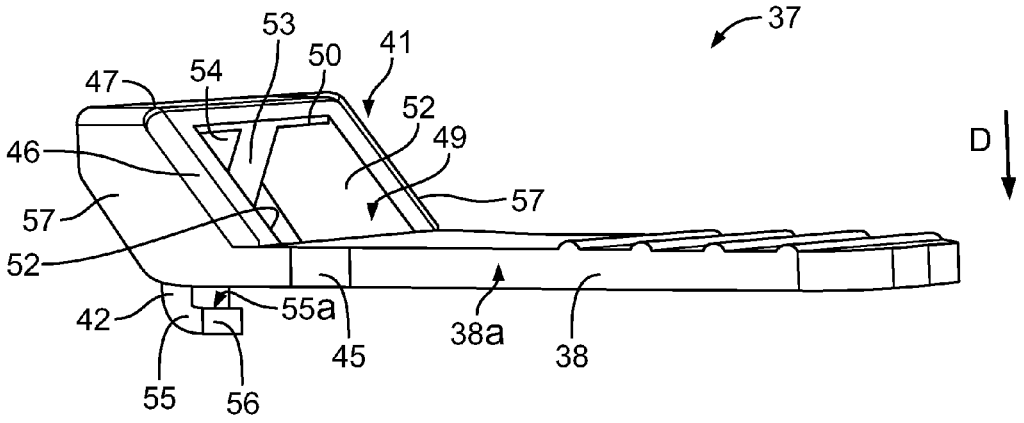
FIG. 2: shows a schematic representation of the release tab according to the first embodiment shown in FIG. 1.
Figure 3:
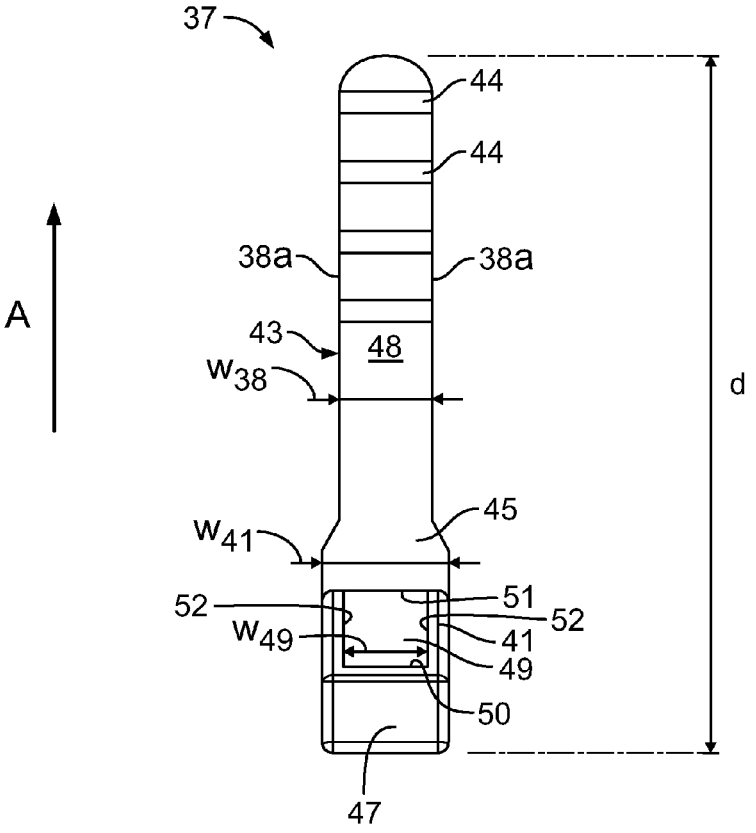
FIG. 3 shows a schematic top view of the release tab of FIG. 2.

FIG. 1 is a perspective view of an exemplary electrical connector 1, formed in accordance with a first exemplary embodiment. The electrical connector 1 represents a plug connector that may be mated with a mating connector 2, represented by a receptacle connector in FIG. 1. The electrical connector 1 and the mating connector 2 are modular connectors, such as the types of electrical connectors used for connected telecommunications equipment or computer networking equipment, such as an RJ45. The exemplary electrical connector 1 of FIG. 1 is coupled to an end of the cable 3. The electrical connector 1 comprises a housing 4 and a ferrule 5 building a shielding element extending from the housing. The ferrule 5 is coupled to the housing 4 using a latch mechanism 6. However, any other type fastener could be used for coupling the ferrule 5 to the housing 4.

The ferrule 5 surrounds the cable 3 and the individual wires (not shown) that form the cable 3. The ferrule 5 is securely coupled to the cable 3 to avoid removal of the cable 3 from the electrical connector 1. For example, the ferrule 5 may comprise a crimping barrel 7, or may be otherwise secured to the cable 3 The ferrule 5 may be fabricated from a metal and thus provide shielding around the end of the cable 3 and the wires of the cable 3.

The housing extends between a mating end 8 at the front of electrical connector and facing against the actuation direction D, and a cable end 18 at the rear facing in the actuation direction A. In the exemplary embodiment, the housing has a cavity (not shown) defined by mating end 8 in the front, a top wall 9, a bottom wall 10 and two opposing side walls 11, 12 of the housing 4.

The electrical connector 1 comprises a latch 13 for securing the electrical connector 1 with the mating connector 2. In the shown embodiment, the latch 13 is integrally with the housing 4 on the exterior surface of the top wall 9.

The latch 13 extends between the fixed end 14 and a distal end or free tip 15. The latch is cantilever such that the distal end 15 is elevated from the top wall 9 of the housing 4 against the unlatching or deflection direction D, in which the latch 13 is moved for being transferred to the unlatched position. In the following, the unlatching direction will be referred to as depression direction D. The latch is connected with the housing 4 via a hinge 16 and is moveable between a latched position, such as the position shown in FIGS. 1 and 4, and an unlatched position, depicted in FIG. 5. The latch may be depressed in the depression direction D from the released position by rotating about the hinge 16 and the fixed end of the latch 13 principally towards the top wall 9 of the housing 4.

The latch 13 comprises a latching surface 17 that is capable of being engaged with the corresponding counter-latching surface (not shown) of the mating connector 2 to securely connector the electrical connector 1 to the mating connector 2. For example, the latching surface 17 of the latch 13 can be brought into engagement with the counter latching surface of the mating connector 2 such that the counter-latching element abuts against the latching surface 17 of the latch 13. In abutment, the latching surface 17 rests along the insertion direction I, along which the connector 1 is inserted into the mating connector 2, behind the counter-latching surface. The insertion direction I principally corresponds to the direction extending from the cable end 18 of the housing towards the mating end 8. This engagement or abutment prohibits the removal of the electrical connector 1 from the mating connector 2.

The latch comprises a window 19 that is designed proximate to the tip 15 of the latch 13. In the exemplary embodiment shown in the figures, the window 19 is rectangular and is defined by a front edge 20, a rear edge 21 and opposing side edges 22 (the front edge 20, the rear edge 21 and the side edges 22 are not shown for the electrical connector 1 according to the first embodiment of FIGS. 1 to 6, but only for the electrical connector 1 according to the second embodiment of FIGS. 7 to 14). In the exemplary embodiments shown in the Figures, the opening 19 of the latch 13 is a through-hole extending entirely through the latch 13 from its top surface 23 to the bottom surface 24.

The electrical connector 1 according to the first embodiment further comprises a boot 25. The boot 25 comprises a strain relief portion 26 that surrounds and is coupled to the cable 3. The strain relief portion 26 is provided at the rear of the boot 25 facing away from the mating end 8 of the housing 4 of the electrical connector 1. Boot 25 can be coloured providing a colour identification to the connector 1. In case of a boot 25 made with clear material, a color codification tag 27, such as a colored clamp 27 can be attached to the boot 25 to serve them as color identification.

The boot 25 further comprise a connector portion 28 that at least section-wise surrounds at least a portion of the electrical connector 1, such as the ferrule 5, as shown in the exemplary embodiment of the electrical connector according to the present invention shown in the Figures. The connector portion 28 is provided at the front of the boot 25, facing in the insertion direction I, and is securely coupled to the ferrule 5 of the electrical connector 1 via a further latching mechanism 29. However, the connector portion 28 of the boot 25 could likewise be securely coupled to the ferrule 5 by a friction fit, an adhesive and the like.

The boot 25 is furthermore provided with a hood 30. The hood 30 extends between a fixed end 31 and a distal tip 32. The hood 30 is cantilevered such that the distal tip 32 is elevated from the top wall 33 of the boot 25, i.e. against the depression direction D. The hood 30 has the form of a lug or tongue whose width $w_{30}$ decreases from the fixed 31 to the distal tip 32. The distal tip 32 extends and is elevated against the depression direction D above the free tip 15 of the latch 13. Due to this alignment of the distal tip 32 of the hood 30 with the free tip 15 of the latch, when the hood 30 is depressed downwards, the hood 30 rotates about its fixed end 31 generally towards the top wall 33. During this movement, the distal tip 32 of the hood 30 engages with and abuts against the free tip 15 of the latch and simultaneously depresses the latch 13 downwards towards the top wall 9 of the housing into the unlatched position. That is, the lug-shaped hood 30 provides a detachment device 34 for transferring the latch 13 to the unlatched position.

The hood 30 includes a slot-shaped opening 35 approximate the fixed end 31. This slot 35 provides a counter-guide element 36 for engaging with part of the release tab 37 according to the present invention, in particular with the body 38. The slot 35 and the body 38 in the exemplary embodiment form a guidance directing the movement of the release tab 37 relative to the housing 4 in and against the actuation direction A. The actuation direction A is generally parallel to but opposing the insertion direction I of the electrical connector 1. The movement of the release tab 37 from the released position along the actuation direction A into an actuated position will be described in detail below.

The release tab is arranged at the top wall 9 of the housing 4 and the top wall 33 of the boot 25. The release tab 37 configured to be pulled in the actuation direction A, shown by the arrow, to actuate the latch 13, i.e. for transferring the latch 13 to the unlatched position. The release tab 37 is moveable between a released position (see e.g. FIG. 4) and an actuated position (see e.g. FIG. 5). When the release tab is pulled with sufficient force in the actuation direction A, the release tab is moved from the released position to the actuated position. When the release tab 37 is released, the release tab can move back to the released position in the direction generally opposing to the actuation direction A, i.e. in the insertion direction I. The release tab 37 may be automatically returned to the released position due to elasticity of the latch 13 so that the person operating the electrical connector 1 does not have to manually push the release tab 37 back to the released position.

In the following, the release tab 37 according to the first embodiment of the electrical connector 1 of the first embodiment shown in FIG. 1 is described in detail.

The release tab 37 comprises a body 38 extending between a mating end 39 and an actuation or pulling end 40. The body 38 according to the shown embodiment is designed as a strip-like body 38. The mating end 39 is designed for engaging with the latch 13 and the cantilever 41 with the unlocking nose 42 are provided at the mating end 39. The engagement of the mating end 39 of the release tab 37 with the latch 13 will be described in detail below.

The pulling end 40 is placed at a distance d from the nose 42 arranged at the mating end 39. The body 38 extends through the slot-like opening 35 in the hood 30, whereby the cross-section of the body 38 corresponds to the slot-shape of the opening 35. Thereby, the body 38 of the release tab 37 forms a guide element 43 for engaging with the counter-guiding element 36 provided by the slot 35 of the hood 30, and for directing the movement of the release tab 37 in the actuation direction A. The strip-shaped or rod-shaped body 38 of the release tab 37 is arranged in the proximity of the top surface of the electrical connector 1, that faces against the depression direction D. The pulling end 40 is freely accessible to the operator for pulling in the actuation direction A that, in the shown embodiment, faces away from the mating end 8 of the housing 4. A plurality of grip elements designed as ribs 44 are provided at the pulling end 40 of the release tab 37, which facilitate pulling the release tab 37 in the actuation direction A by providing a better grip on the body 38.

The cantilever 41 is arranged at the mating end 39 of the release tab 37. In the shown embodiment, the cantilever 41 is integrally formed with the body 38 of the release tab 37 and projects from the body 38 in the direction opposite to the depression direction D. A base portion 45 of the cantilever 41 is arranged at the mating end 39 of the release tab body 38. In the base portion 45, the width of the release tab 37 is widened so that the width $W_{38}$ of the body strip 38 is smaller than the width $W_{41}$ of the cantilever. The base 45 of the cantilever 41 is principally arranged in the plane defined by the body strip 38.

The cantilever 41 extends from the base portion 45 via a slant portion 46 up to a retaining end 47 that is the free end of the cantilever 41. In the following, the retaining end 47 is also referred to as the free end 47 of the cantilever 41. While the base 45 of the cantilever 41 is principally arranged in the plane defined by the body strip 38, the slant portion 46 is elevated against the depression direction D from the top surface 48 of the body 38 and the base 45. The slant portion 46 is provided with a window 49. The window is of a rectangular shape in the shown exemplary embodiment and is defined by the forward edge 50, at the retaining end 47, a rearward edge 51, the base 45, and side edges 52. The distance between the side edges 52, i.e. the width $W_{49}$ of the window 49 principally corresponds to the width $W_{38}$ of the release tab body 38 in the shown embodiment. However the width $W_{49}$ and width $W_{38}$ can also have different measure in width.

The retaining end 47 of the cantilever 41 principally runs parallel to the tab body 38 but is elevated with respect to the body 38 against the depression direction D. An embossment forming the unlocking nose 42 is provided in the retaining end 47 of the cantilever 41. The unlocking nose 42 includes a ramp surface 53 that extends from a base 54 to a tip 55. The ramp surface 53 is generally rearward-facing, i.e. facing towards the pulling end 40, while the unlocking nose 42 generally is arranged perpendicular to the plane of the tab body 38, i.e. parallel to the depression direction D. At the tip 55, the unlocking nose 42 is provided with a stopper 56. The stopper 56 is designed as a hook, protruding generally in the actuation direction A towards the pulling end 40 of the release tab 37. The retaining end 47, that is the free end of the cantilever 41 is arranged, in the projection along the depression direction D, before the body 38. The tip 55 of the is arranged, in the projection along the depression direction D, after the body 38. Thus the free or retaining end 47 of the cantilever 41 and the tip 55 of the nose 42 are arranged on opposite side of the body, namely, the free or retaining end 47 at the top side of surface 48, and the tip at the bottom side of surface 48*a*.

The assembly of the release tab 37 with the electrical connector 1 and the unlatching of the latch 13 by transferring the release tab 37 from the released position (FIG. 4) to the unlatched position (FIG. 5) will now be explained in detail with respect to FIG. 4 (assembly of electrical connector 1 with the release tab 37 in the released position), FIG. 5 (assembly of electrical connector 1 with the release tab 37 in the actuated position) and FIG. 6 (electrical connector 1 in a pre-assembled state, where the release tab 37 is not yet assembled with the other parts of the electrical connector 1).

Assembly of the electrical connector 1, more particular, positioning arrangement of the release tab 37 is accomplished in the exemplary embodiment, by loading the release tab 37 from the front at the mating end 8 of the electrical connector 1. For the assembly, the latch 13 has to be depressed down in the depression direction D making way for inserting the release tab 37 with the pulling end 40 first along the actuation direction A between the depressed latch 13 and beneath the hood 30 through the slot-like opening 35 provided in the proximity of the fixed end 31 of the hood 30. The release tab 37 is inserted until the mating end 39 of the release tab 37 engages with the latch 13. When the unlocking nose 42, particularly the tip 55 of the nose 42, is arranged in the opening 19 of the latch 13, which is the case when the elevated retaining portion 47 upon insertion of the release tab 37 abuts against the distal tip 32 of the hood, the depressed latch 13 can be released.

Figure 4:
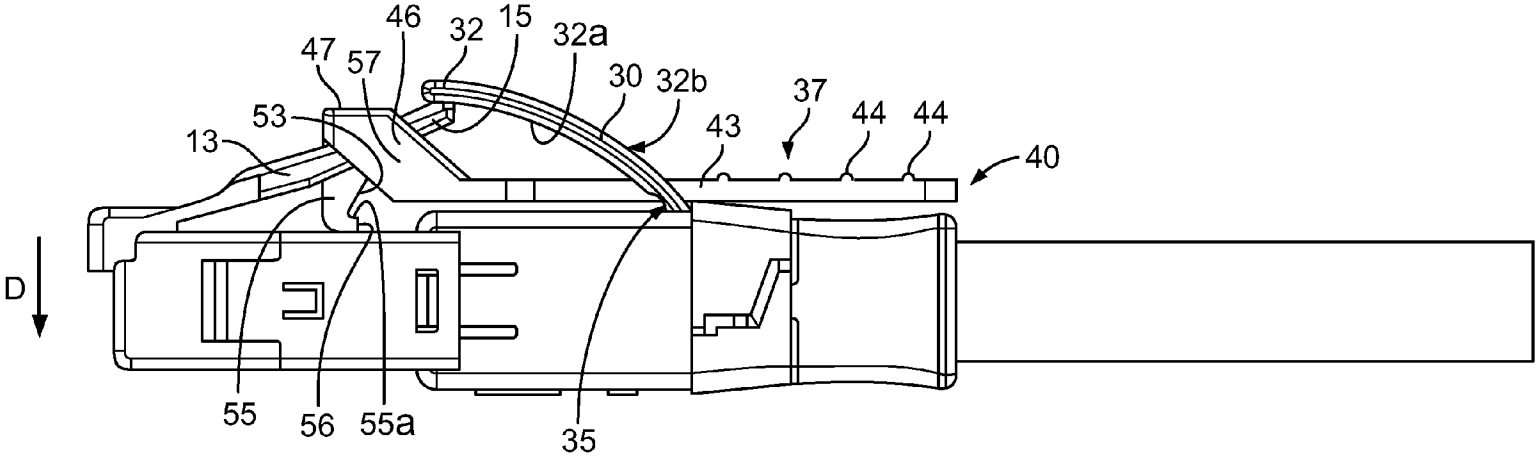
FIG. 4: shows a side view of the electrical connector of FIG. 1 comprising the release tab of FIGS. 2 and 3 in the released position.

Upon release, the latch 13 snaps back into the latching position and the electrical connector 1 is assembled with the release tab 37 in the released position, as shown in FIG. 4. In this position, the free tip 15 of the latch 13 rests against the bottom surface 32*a* of the distal tip 32 of the hood 30. However, it is not mandatory for the tip 32 of the hood 30 to be in contact with the free tip 15. The unlocking nose 42 extends through the opening 19 in the latch 13 and, in this position where the unlocking nose 42 is received in the opening 19, the ramp surface 53 is generally facing the rear edge 21 of the opening 19. The distal portion 15 of the latch 13 itself is received in and extends through the window 49 provided in the slant portion 46 of the cantilever 41. The cantilever comprises side walls 57 provided with side edges 42 of the window, which guide the movement of the latch 13, when depressed downwards in the depression direction D and avoid tilting of the latch 13 out of the plane defined by the depression direction D and the actuation direction A.

For releasing the electrical connector 1 from the mating connector 2, the latch has to be transferred to the unlatched position. This can be done by actuating the release tab 37. The tab 37 is actuated by moving the release tab 37 from the released position, shown in FIG. 4, to the actuated position shown in FIG. 5, in the actuation direction A. For this transfer, the release tab 37 is gripped in the pulling end 40 and pulled in the actuation direction A. When pulling the release tab 37 in the actuation direction A, the ramp surface 53 engages the rear edge 21 of the opening 19 and the rear edge 21 slides down the ramp surface 53 from the base 54 to the tip 55 until the latch 13 abuts against the inner surface 55*a* of the stopper 56 that faces against the depression direction D. Thereby, the stopper 56 avoids that the unlocking nose 42 can be moved out of the opening 19 in the release tab 37 and thus limits the movement of the release tab 37 relative to the rest of the electrical connector 1 in the actuation direction A and against the depression direction D.

Figure 5:
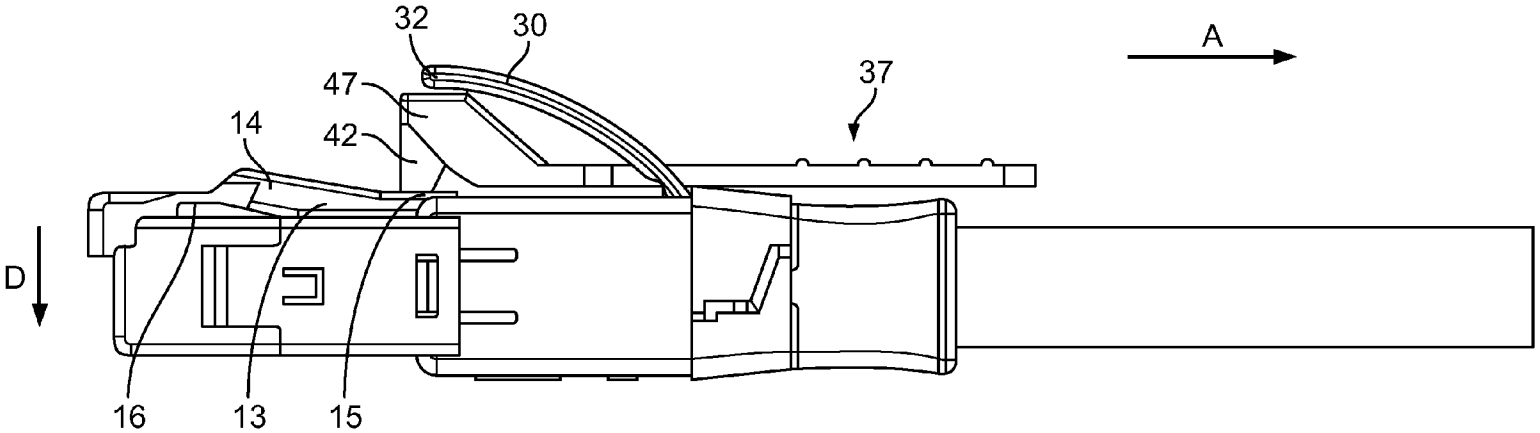
FIG. 5: shows a side view of the electrical connector of FIG. 1 comprising the release tab of FIGS. 2 and 3 in the actuated position.
Figure 6:
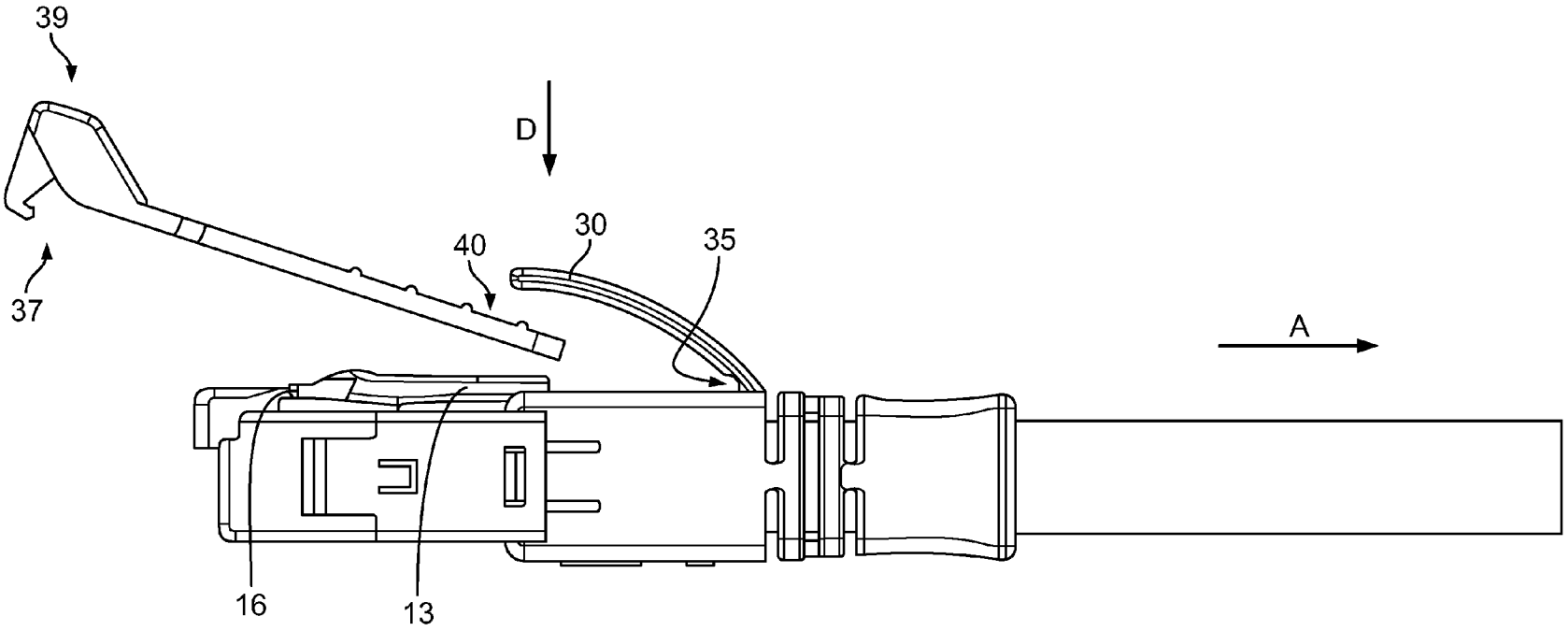
FIG. 6: shows the electrical connector of FIG. 1 having its latch depressed and the release tab not yet arranged at the electrical connector.

As the release tab 37 is pulled in the actuation direction A, the latch 13 is moved from the released position of FIG. 4 to the unlatched position, as shown in FIG. 5, whereby the free tip 15 of the latch 13 is rotated about the fixed end 14 at the hinge 16 generally towards the top wall 9 of the housing 4. In the released position, the latching surface 17 of the latch 13 engages with a counter-latching surface (not shown) of the mating connector 2. When moving the latch 13 in the depression direction D, the latching surface 17 of the latch 13 is moved out of the engagement with the counter-surface (not shown) of the mating connector. In the unlatched position, the latching surface 17 does not longer block disconnecting the mating connector 2 against the insertion direction I from the mating connector 2.

As an alternative to transferring the latch 13 to the unlatched position by pulling the release tab 37 in the actuation direction A, the operator may push on the upper side 58 of the hood 30. Such push deflects the distal tip of the hood 32 towards the top wall 33 of the boot 25, i.e. in the depression direction D. During the deflection, the tip 32 of the hood 30 engages with the distal end 15 of the latch 13 taking the latch 13 along with the hood 30 in the depression direction D. The cantilever 41 of the release tab 37 does not interfere with the depression of the hood 30 since the tip 32 of the hood can enter the window 49 provided in the slant portion 46 of the cantilever 41. The window thus guide the deflection of the latch 13 and the hood 30 in and against the depression direction D.

In the following, a second embodiment of the electrical connector 1 comprising a release tab 37 according to a second embodiment is described with reference to the FIGS. 7 to 14. For elements having a similar or identical structure/function as elements of the first embodiment according to FIGS. 1 to 6, the same reference signs are used. In the following, only the differences between the further embodiment of the electrical connector 1 and the release tab 37 with respect to the first embodiment are described.

Figure 7:
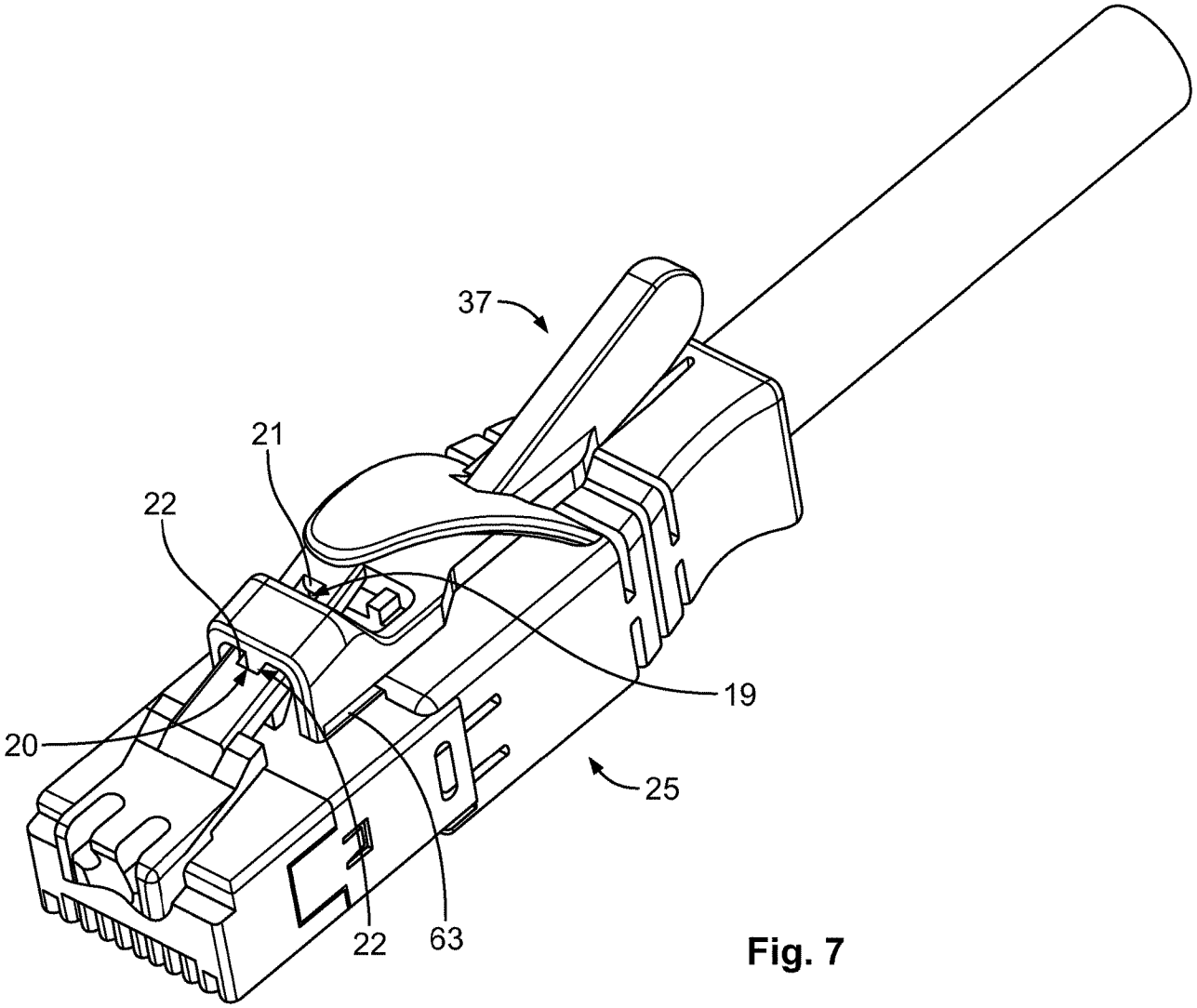
FIG. 7: shows a schematic illustration of an electrical connector according to a second embodiment comprising a release tab according to a second embodiment.
Figure 8:
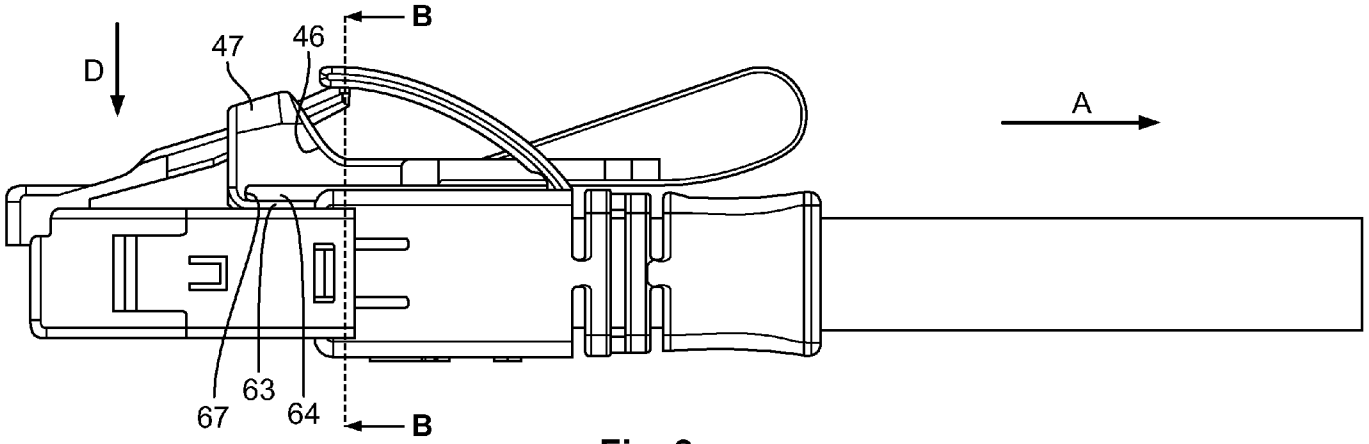
FIG. 8: shows a side of the electrical connector of the FIG. 7.

FIG. 7 is a perspective view and FIG. 8 is a side view of an exemplary electrical connector 1 according to a second embodiment. The electrical connector 1 principally corresponds to the first embodiment, as shown in FIGS. 1 to 6. In the following, the main differences lie basically in the design of a release tab 37 according to a second embodiment as well as the design of the boot 25.

Figure 9:
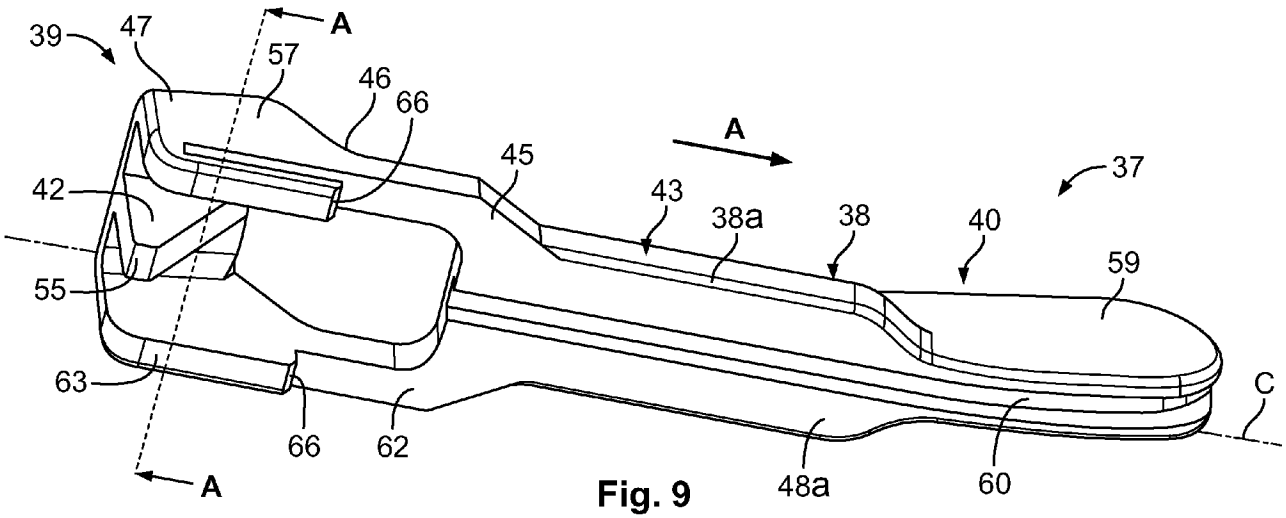
FIG. 9: shows a schematic representation of the release tab according to the second embodiment.
Figure 10:
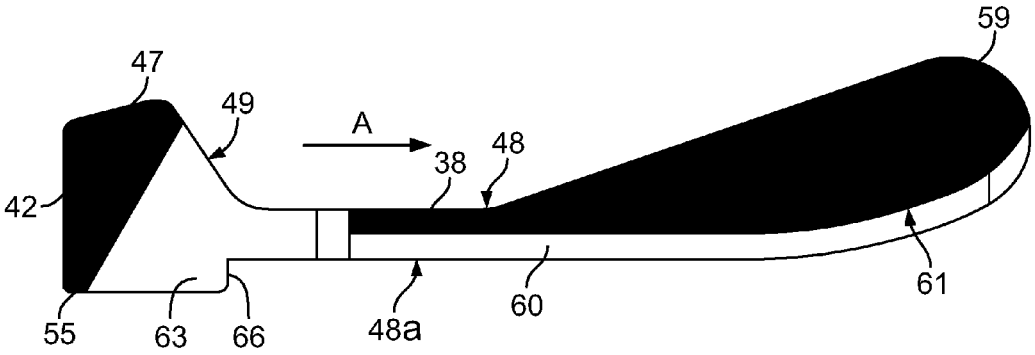
FIG. 10: is a longitudinal cut of the release tab of FIG. 9.
Figure 11:
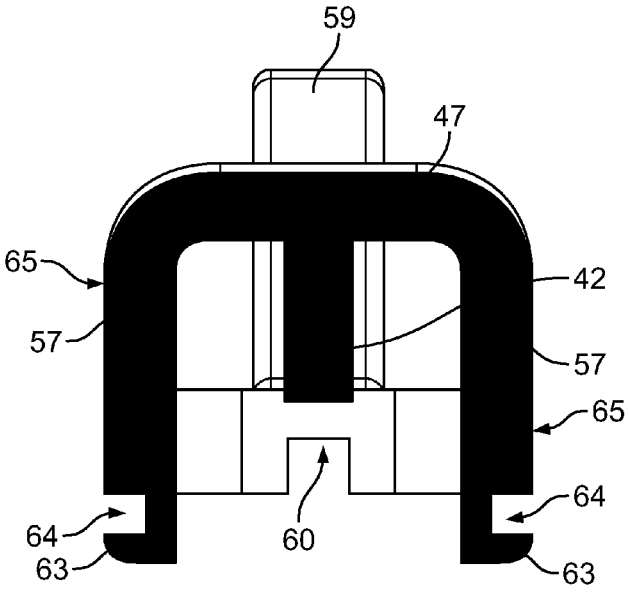
FIG. 11: shows a cross-sectional view of the release tab according to the second embodiment shown along the section line A-A of FIG. 9.

The release tab 37 according to the second embodiment is shown in detail in perspective view in FIG. 9, in a longitudinal cut along the longitudinal axis corresponding to the actuation direction A, in FIG. 10 and in a cross-sectional representation cut perpendicular to the actuation direction A along the section line A-A at the retaining end 47 of FIG. 9.

The body 38 according to the second embodiment is provided at the mating end 39 with a handle 59 that can be gripped by the operator. The handle is generally wing-shaped, arranged along the centre line C that is parallel to the actuation direction A of the body 38, and elevates from the top surface 48 of the body. At the bottom 48*a*, the body 38 is provided along its longitudinal centre line C with a groove 60. The groove 60 extends from the mating end 39 of the body 38 in the actuation direction A through the complete body 38 up to the free end of the handle 59. The groove 60 forms a second guiding element 61, in addition to the first guiding element 43 formed by the side walls 38*a* of the body.

The release tab 37 according to the second embodiment further differs in the design of the side walls 57 of the cantilever. The side walls 57 generally extend from the top of the cantilever at the retaining end 47 down to the level of the body 38.

The side walls 57 of the cantilever 41 and the retaining end 47 of the cantilever 41 forms a dome with the retaining end 47 building the yoke between the side walls 57. The unlocking nose 42 protrudes downwards from the yoke or the top of the dome, i.e. the retaining portion 47. At its bottom 62, the cantilever 41 is provided with two guide rails 63. Guide rails 63 extend from the front of the release tab 37, facing against the actuation direction A, generally along the actuation direction A, at the lengths that principally correspond to the sum of the retaining portion 47 and the slant portion 46.

The guide rails 63 are formed by providing grooves 64 extending substantially parallel to the actuation direction A at the exterior sides 65 of the side walls 57. The guiding grooves 64 open at the rearward-facing end 67 of the guide rails 63 but do not extend completely through the guide rails 63. Rather, the groove 64 end in the proximity of the front of the release tab 37 in a dead end forming a limit stop 67 of this third guide element 63, 64 of the release tab 37. The grooves furthermore provide a catch 79 for securing the release tab 37 against lifting off from the electrical connector 1 against the depression direction D.

Figure 12:
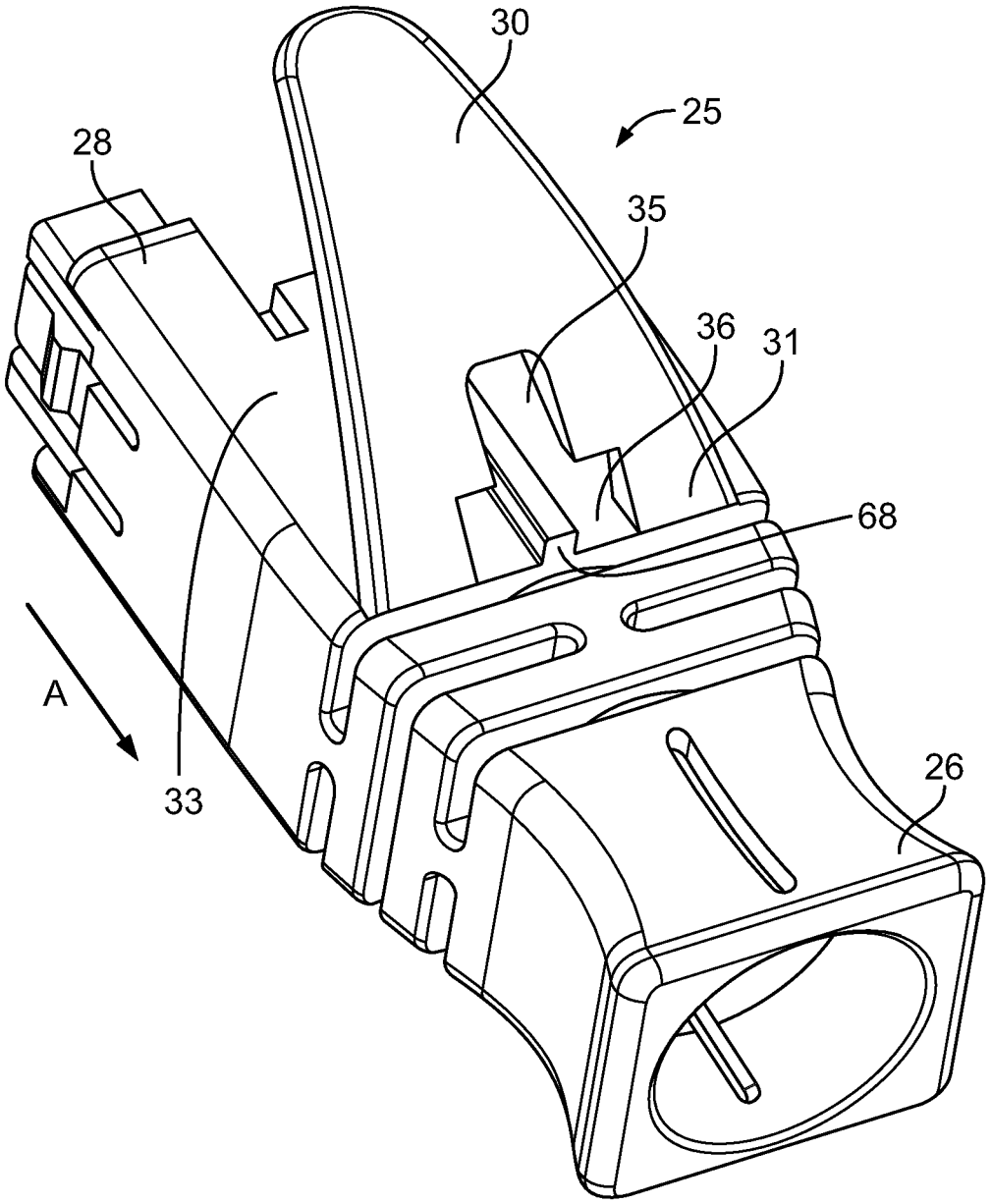
FIG. 12: shows a schematic rear view of the boot according to the electrical connector of FIG. 7.
Figure 13:
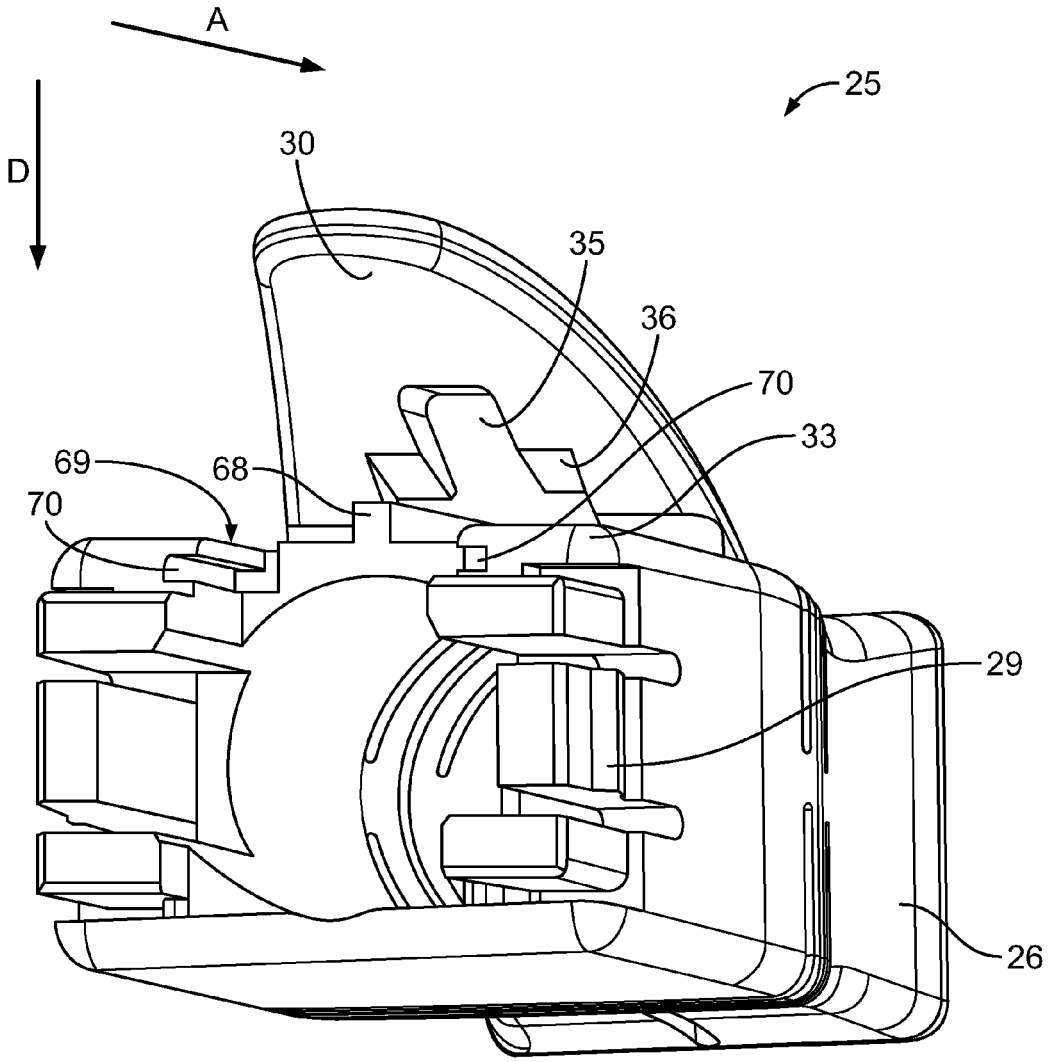
FIG. 13: shows a schematic front view of the boot according to the electrical connector of FIG. 7.

The boot 25 of the electrical connector 1 according to the second embodiment is shown in a perspective view from the rear part with a strain relief portion 26 in FIG. 12 and from the front with a connector portion 28 in FIG. 13. In the boot 25 according to the second embodiment, the opening 35 in the hood 30 is adapted to the design of the release tab 37 according to the second embodiment. Since the body 38 of the release tab is provided with a handle 59, extending substantially perpendicular from the centre line C out of the top surface of the body 48, the opening 35 in the boot 25 according to the second embodiment has a substantially T-shape.

Furthermore, on the top wall 33 of the boot 25, a rail 68 is provided that substantially runs parallel to the actuation direction A in the centre of the top wall 33 of the boot 25. The rail 68 extends from the front of the connector portion 28 up to the fixed end 31 of the hood 30, namely extends up into the opening 35 that is T-shaped in the boot 25 according to the second embodiment of the electrical connector 1.

The boot 25 of the second embodiment is furthermore provided with further counter-guiding elements 69 that are designed as guide grooves 70 in the top wall of the boot. The grooves 70 form a guidance with the guide rail 63 of the release tab 37. The grooves 70 open at the front at the connector portion 28 and extend substantially parallel to the actuation direction A.

The guide rails 68 that are elevated against the depression direction D from the exterior surface of the top wall 33 of the boot and form a counter-guide element 69 for the groove 60 at the bottom of the body 38. The T-shaped opening 35 at the fixed end 31 of the hood forms a further guidance with the T-shaped cross-section of the body 38 of the release tab provided with the handle 59 arranged substantially parallel thereto. A third guidance is built by the channels or grooves 70 provided at a connector portion 28 in the top wall 33 of the boot 25 on one hand and by the guide rails 63 and the guide grooves 64 at the bottom of the cantilever 41 on the other hand. The electrical connector 1 according to the second embodiment is thus provided with three guideways for directing the movement of the release tab 37 in the actuation direction A.

Figure 14:
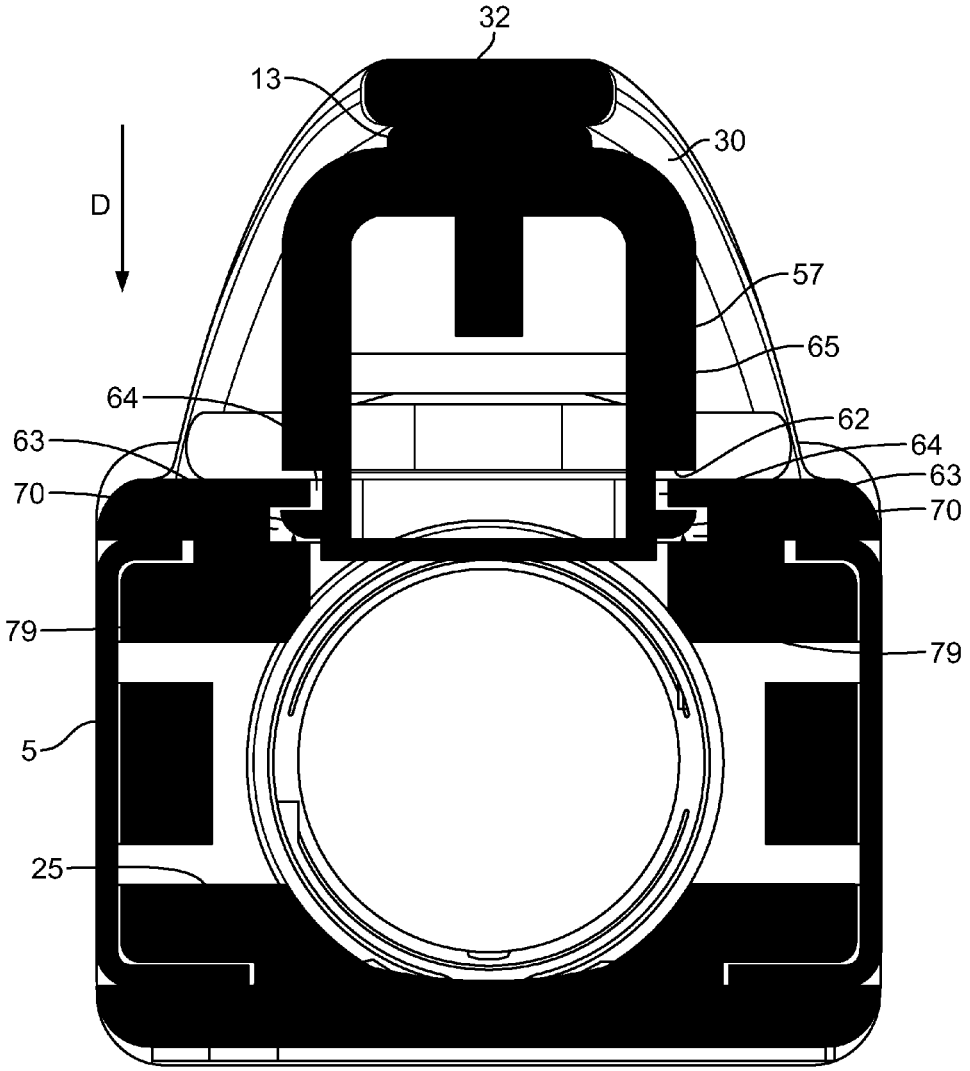
FIG. 14: shows a cross-sectional view of the electrical connector of FIG. 8 cut along section line B-B.

The guidance formed between the guide rails 63/guide grooves 64 at the bottom 62 of the cantilever 41 and the channel 60 provided at the connector portion 28 of the top wall 33 of the boot 25 is shown in detail in FIG. 14. As can be seen, the guide rails 63 and/or guide grooves 64 simultaneously provide a catch 79 for securing the release tab 37 against lifting off from the electrical connector 1 against the depression direction D due to the counteracting forces the latch 13 acts on the nose 42 and the cantilever 41 when being depressed in the depression direction D.

Figure 15:
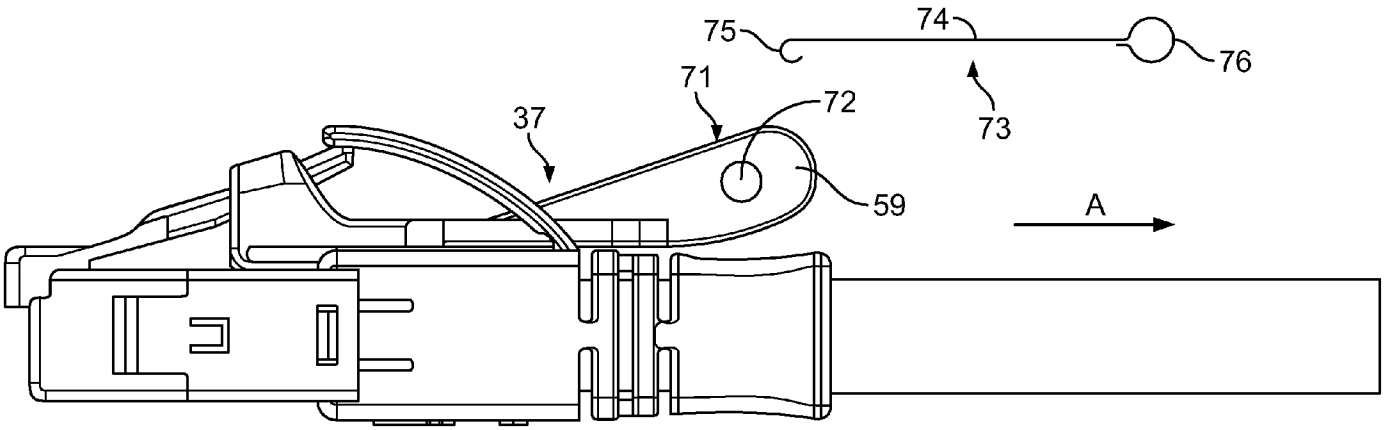
FIG. 15: shows a side view of the electrical connector with a release tab according to a third embodiment.
Figure 16:
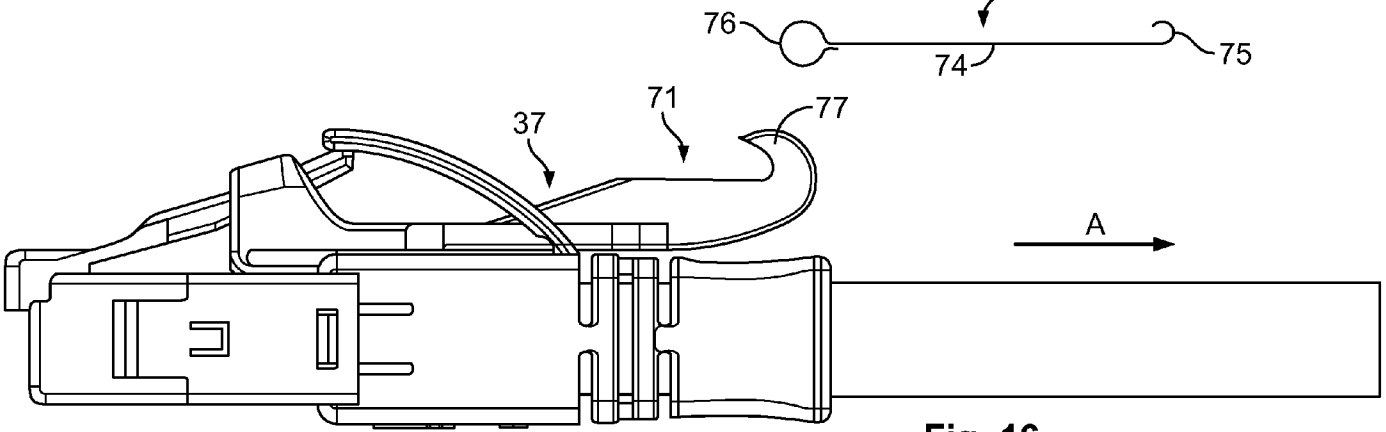
FIG. 16 shows a side view of the electrical connector with a release tab according to a forth embodiment.
Figure 17:
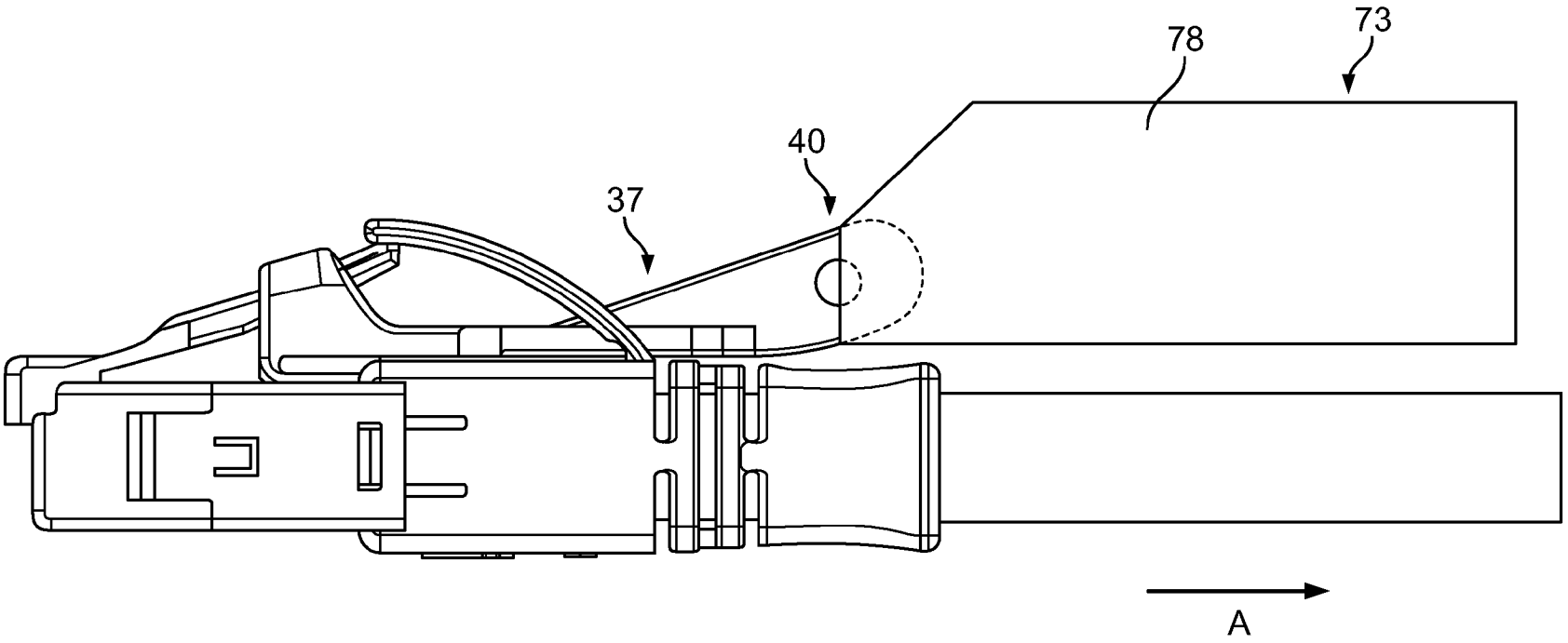
FIG. 17 shows a side view of the electrical connector with a release tab according to a fifth embodiment.

In the FIGS. 15 to 17, variations of the electrical connector 1 according to the second embodiment in side view, corresponding to FIG. 8. The electrical connectors 1 shown in FIGS. 15 to 17 are provided with variations of the release tab 37 shown in FIG. 8, according to a third to a fifth embodiment. In the following, only the differences with respect to the release tab 37 according to the third to fifth embodiment are described.

In the release tab 37 according to third embodiment, the body 38 comprises a coupling element 71. The coupling element 71 of the third embodiment is designed as a hole 72 provided in the handle 59 of the release tab 37. Alternatively, the hole 72 constituting the coupling devices 71 could be provided in any other part of the release tab that is freely accessible from the rear. An actuation device 73 can be attached to and coupled with the coupling element 71.

In the shown embodiment, the actuation device 73 is a rod 74, one end of which is provided with a hook 75, that can be coupled with the hole 72 in the handle 59 that constitutes a coupling device 71 of the release tab 37. The other end of the actuation device 73, i.e. at the end of the rod 74 opposite to the hook 75, is provided a loop 75 or an eye that can be used as a grip or handle for holding the actuation device 73 and manipulating the actuating device 73 for coupling the hook 75 with the hole 72 so that the release tab 37 can be moved from the released position into the actuated position by pulling the actuation tool 73 that takes along the release tab 37 in the actuation direction A. Thus, the electrical connector 1 having a release tab 37 according to the third embodiment can be unlatched from a greater distance by using the actuating device 73 so that the operator does not need to grip the body 38 of the release tab 37, but can use the elongated actuation device 73.

The release tab 37 according to a fourth embodiment, as shown in FIG. 16, is likewise provided with a coupling element 71. In this exemplary embodiment, the coupling element 71 is also arranged in the handle 59. Contrary to the hole 72 forming the coupling element 71 in the third embodiment, the rear end of the handle 59 facing in the actuation direction A is provided with a hook 76. This hook 76 can be coupled with an actuation device 73 having at one end thereof a loop or an eye 75. Upon coupling such loop 75 with the hook 76 of the release tab 37, the release tab can be moved into the actuated position from a distance using the actuation device 73. The actuating device 73 can be the same actuating device 73 shown in FIG. 15, when used with a release tab 37 according to the fourth embodiment shown in FIG. 16. In case of the fourth embodiment of FIG. 16, however, the loop 76 is coupled with the hook 77 of the release tab 37 and the hook 75 at the opposite side of the rod 74 thereof can be used as a grip or handle for pulling the actuating device 73 once attached to the release tab 37.

The actuation tool 73 used a puller tool for moving the release tab 37 in the actuated position may be attached to and detached from the release tab 37. Likewise, the actuation device or tool 73 can be permanently attached to the release tab 37. The length of the actuating devices 73 can be easily adapted by providing the desired rod length of the rod 74.

In order to avoid rather lengthy actuating devices 73 from hanging down from the release tab 37, the end of the actuating device 73 that is provided with a handle may be attached to the cable of the electrical connector 1, for example by using a cable, a clip or tape, or any other means.

The fifth embodiment of the release tab 37 shown in FIG. 17 comprises an actuation device 73 that is attached to the body. In the fifth embodiment, the actuation device 73 is a label that may be made from plastic or cloth, one end of which is attached to the pulling end 40 of the release tab 37. In the shown embodiment, one side of the label 78 is attached to, e.g. by an adhesive with the rear part of the handle 59 facing in the actuation direction A. Using a label made from plastic or cloth has the advantage that it can be easily adjusted to the desired length. Furthermore, this label likewise forms a handle, i.e. representing an elongation of the handle 59. Moreover, the label 78 can be used to provide information, e.g. about the electrical connector 1 and the mating connector 2 or may be provided with a color codification.

The invention claimed is:

1. A connector comprising:

a housing having a first surface and an opposite second surface, at least a portion of the second surface being positioned on a first plane;

a latch for securing the housing to a mating connector, the latch having a fixed end extending from the first surface and a distal end defining an opening through the latch, wherein the distal end moves in a depression direction toward the housing between a latched position and an unlatched position, wherein the first plane is normal to the depression direction;

a slidable member movable relative to the housing between a released position and an actuated position, and having an unlocking nose extending into the opening to transfer the latch to the unlatched position when the slidable member is moved from the released position to the actuated position, wherein the slidable member includes a pulling end having a grip, and wherein the distance between the grip and the first plane is less than the distance between the distal end of the latch and the first plane when the latch is in the latched position;

the slidable member having a mating end that defines a window; and the unlocking nose extending from a top of the window downward into the opening in the distal end of the latch.

2. The connector of claim 1, wherein the unlocking nose includes a ramp slanted with respect to the grip, the ramp engaging the latch when the slidable member slides from the released position to the actuated position.

3. The connector of claim 1, wherein the connector includes a boot having a concave outer contour.

4. The connector of claim 3, wherein the boot has a cable-receiving end having a rectangular shape and defining a circular-shaped opening for receiving a cable.

5. The connector of claim 4, wherein the boot includes a plurality of ribs.

6. The connector of claim 3, wherein the boot is separate from the grip.

7. The connector of claim 1, further including a cantilevered hood that extends over the distal end of the latch.

8. The connector of claim 1, wherein the connector is an electrical connector, and wherein the housing at least partially surrounds at least one electrical contact.

9. The connector of claim 1, wherein the connector includes a stop that limits movement of the slidable member relative to the housing.

10. The connector of claim 9, wherein the stop is on the slidable member.

11. The connector of claim 1, wherein the slidable member further comprises a base portion and a retaining end extending from the base portion via a slant portion, the slant portion being elevated against the depression direction, and the unlocking nose extending from the retaining end towards the first plane of the housing.

12. The connector of claim 1, wherein the distal end of the latch extends through the window when the latch is in the latched position.

13. The connector of claim 1, wherein the distal end of the latch extends at least to the window when the latch is in the latched position.

14. A connector comprising:

a housing having a first surface and an opposite second surface, at least a portion of the second surface being positioned on a first plane;

a latch for securing the housing to a mating connector, the latch having a fixed end extending from the first surface and a distal end defining an opening through the latch, wherein the distal end moves in a depression direction toward the housing between a latched position and an unlatched position, wherein the first plane is normal to the depression direction;

a slidable member movable relative to the housing between a released position and an actuated position, and having an unlocking nose extending into the opening to transfer the latch to the unlatched position when the slidable member is moved from the released position to the actuated position, wherein the slidable member includes a first end having a grip and a second end having an actuating member engaging the latch, wherein the actuating member includes the unlocking nose that extends toward the first plane from a portion of the actuating member that is spaced from the first plane a distance greater than the distance that the grip is spaced from the first plane;

the second end of the slidable member defining a window; and the unlocking nose extending from a top of the window downward into the opening in the distal end of the latch.

15. The connector of claim 14, wherein the actuating member is a cantilever.

16. The connector of claim 14, wherein the grip is positioned closer to the housing than the distal end of the latch when the latch is in the latched position.

17. The connector of claim 14, wherein the housing includes a first guiding member and the slidable member includes a second guide member that engages the first guiding member to guide the slidable member as it moves between the released position and the actuated position.

18. The connector of claim 14, wherein the slidable member further comprises a base portion and a retaining end extending from the base portion via a slant portion, the slant portion being elevated against the depression direction, and the unlocking nose extending from the retaining end towards the first plane of the housing.

19. The connector of claim 14, wherein the distal end of the latch extends through the window when the latch is in the latched position.

20. The connector of claim 14, wherein the distal end of the latch extends at least to the window when the latch is in the latched position.

21. A connector comprising:

a housing having a first surface and an opposite second surface, at least a portion of the second surface being positioned on a first plane;

a latch for securing the housing to a mating connector, the latch having a fixed end extending from the first surface and a free end having an opening, wherein the free end moves in a depression direction toward the housing between a latched position and an unlatched position, wherein the first plane is normal to the depression direction;

a slidable member movable relative to the housing between a released position and an actuated position, and having an unlocking nose extending into the opening to transfer the latch to the unlatched position when the slidable member is moved from the released position to the actuated position, wherein the slidable member has a first end having a grip and a second end having cantilever that extends toward the latch, wherein the distance between the grip and the first plane is less than the distance between the free end of the latch and the first plane when the latch is in the latched position, and wherein the nose is arranged at the cantilever and extends downward from a surface of the cantilever;

the cantilever defining a window; and the unlocking nose extending from a top of the window downward into the opening in the distal end of the latch.

22. The connector of claim 21, further including a cantilevered hood that extends over the free end of the latch.

23. The connector of claim 22, further including a boot, wherein the hood extends from the boot.

24. The connector of claim 21, wherein the housing includes a first guiding member and the slidable member includes a second guide member that engages the first guiding member to guide the slidable member as it moves between the released position and the actuated position.

25. The connector of claim 21, wherein the slidable member further comprises a base portion and a retaining end extending from the base portion via a slant portion, the slant portion being elevated against the depression direction, and the unlocking nose extending from the retaining end towards the first plane of the housing.

26. The connector of claim 21, wherein the distal end of the latch extends through the window when the latch is in the latched position.

27. The connector of claim 21, wherein the distal end of the latch extends at least to the window when the latch is in the latched position.

* * * * *